US010570922B2

(12) United States Patent
French

(10) Patent No.: US 10,570,922 B2
(45) Date of Patent: Feb. 25, 2020

(54) COMPRESSOR

(71) Applicant: Cummins Ltd, Huddersfield (GB)

(72) Inventor: Pierre Bernard French, Holmfirth (GB)

(73) Assignee: Cummins Ltd., Huddersfield (GB)

( * ) Notice: Subject to any disclaimer, the term of this patent is extended or adjusted under 35 U.S.C. 154(b) by 230 days.

(21) Appl. No.: 15/638,650

(22) Filed: Jun. 30, 2017

(65) Prior Publication Data

US 2018/0003191 A1 Jan. 4, 2018

(30) Foreign Application Priority Data

Jun. 30, 2016 (GB) ..... 1611411.8

(51) Int. Cl.

| | |
|---|---|
| ***F04D 29/44*** | (2006.01) |
| ***F04D 29/62*** | (2006.01) |
| ***F04D 25/02*** | (2006.01) |
| *F02B 37/00* | (2006.01) |
| *F04D 29/28* | (2006.01) |

(52) U.S. Cl.

CPC ..... *F04D 29/441* (2013.01); *F04D 25/024* (2013.01); *F04D 29/624* (2013.01); *F02B 37/00* (2013.01); *F04D 29/284* (2013.01)

(58) Field of Classification Search

CPC ..... F04D 29/441; F04D 29/284; F02B 37/00; F01D 21/045

USPC ..... 415/9; 416/2

See application file for complete search history.

(56) References Cited

U.S. PATENT DOCUMENTS

| | | | | |
|---|---|---|---|---|
| 3,490,748 | A * | 1/1970 | Hoffman | F01D 21/006 188/185 |
| 5,868,552 | A | 2/1999 | McKean et al. | |
| 6,264,424 | B1 * | 7/2001 | Fuller | F01D 21/045 415/206 |
| 2011/0041494 | A1 | 2/2011 | Parker et al. | |

(Continued)

FOREIGN PATENT DOCUMENTS

| | | | |
|---|---|---|---|
| DE | 2706110 | A1 | 8/1978 |
| DE | 102011010673 | A1 | 8/2012 |

(Continued)

OTHER PUBLICATIONS

Examination report issued by the United Kingdom Intellectual Property Office, dated Nov. 15, 2017, for related Application No. GB1611411.8; 6 pages.

*Primary Examiner* — Justin D Seabe

(74) *Attorney, Agent, or Firm* — Faegre Baker Daniels LLP

(57) ABSTRACT

A compressor comprises a compressor housing, a compressor wheel mounted within the housing and having compressor blades, and a bearing housing. The compressor housing comprises a cover member and a diffuser member that is connected to both the cover member and the bearing housing. The diffuser member has a radially outer portion connected to the cover member and a radially inner portion connected to the bearing housing. The diffuser member has a first weakened region defined at a first position intermediate the radially outer portion and the radially inner portion, and a first strengthened region defined at a second position intermediate the radially outer portion and the radially inner portion, said second position being radially inwards or outwards of the first weakened region.

20 Claims, 5 Drawing Sheets

(56) References Cited

U.S. PATENT DOCUMENTS

2011/0283711 A1* 11/2011 Petersson ..... F01D 9/041
60/796

FOREIGN PATENT DOCUMENTS

EP 0908629 A1 4/1999
EP 0908629 A1 4/1999

* cited by examiner

COMPRESSOR

CROSS-REFERENCE TO RELATED APPLICATIONS

The present application claims priority to UK Application No. 1611411.8, filed Jun. 30, 2016, titled "A COMPRESSOR," the entire disclosure of which being expressly incorporated herein by reference.

FIELD OF THE DISCLOSURE

The present disclosure relates to a compressor, particularly but not exclusively, a compressor for use in a turbocharger.

BACKGROUND

Turbochargers are well known devices for supplying air to the intake of an internal combustion engine at pressures above atmospheric pressure (boost pressures). A conventional turbocharger essentially comprises a housing in which is provided an exhaust gas driven turbine wheel mounted on a rotatable shaft connected downstream of an engine outlet manifold. A compressor impeller wheel is mounted on the opposite end of the shaft such that rotation of the turbine wheel drives rotation of the impeller wheel. In this application of a compressor, the impeller wheel delivers compressed air to the engine intake manifold. The turbocharger shaft is conventionally supported by journal and thrust bearings, including appropriate lubricating systems.

The compressor impeller is mounted in a compressor housing which comprises a cover plate, a portion of which closely follows the contours of the impeller blades and a portion of which defines an annular inlet passageway, and a diffuser flange that is fixedly connected between the cover plate and a bearing housing that retains the bearings for the compressor and the turbine.

There is an ever-increasing demand for turbochargers of higher performance, particularly with vehicles of high horse power. In order to meet this demand it has been necessary to manufacture the compressor impeller from titanium so that the compressor can withstand the high pressure ratios and arduous operating conditions. A disadvantage of an impeller made from titanium or another high density material (e.g. stainless steel) relative to the current aluminium alloy impellers is that the increased density makes the impeller more difficult to contain in the event of its failure. Failure of the compressor impeller can occur through defects in the titanium, consistent use of the turbocharger at speeds in excess of its top speed limit, or fatigue damage to the material caused by continually cycling between high and low turbocharger speeds in extreme duty cycles. When the compressor impeller fails in use it is desirable to contain the radially projected fragments within the compressor housing to reduce the potential for damage to the turbocharger or injury to personnel. Generally small fragments are relatively easily contained but larger fragments tend to damage the compressor housing or diffuser flange through their force of impact. At particular risk is the connection between the diffuser flange and the bearing housing. If the two are separated oil leakage from the bearing housing can occur thereby increasing the risk of fire in the engine compartment or failure of the engine.

SUMMARY

It is an object of the present disclosure to obviate or mitigate one or more of the problems set out above.

According to a first aspect of the present disclosure there is provided a compressor comprising a compressor housing, a compressor wheel mounted within the housing and having compressor blades, and a bearing housing, the compressor housing comprising a cover member and a diffuser member that is connected to both the cover member and the bearing housing, the diffuser member having a radially outer portion connected to the cover member and a radially inner portion connected to the bearing housing, wherein the diffuser member has a first weakened region defined at a first position intermediate the radially outer portion and the radially inner portion and a first strengthened region defined at a second position intermediate the radially outer portion and the radially inner portion, said second position being radially inwards or outwards of the first weakened region.

In this way, the kinetic energy of high velocity material ejected by a failed compressor wheel can be absorbed by the diffuser member, significantly reducing the risk of failure of the compressor housing, and of the connection between the compressor housing and the bearing housing, which, in turn, reduces the risk of oil leaking from the bearing housing. Providing a strengthened region in combination with the weakened region improves the extent to which the kinetic energy from the ejected material is focussed at the weakened region, thereby enhancing the reliability of the diffuser. Set out below are various preferred embodiments of the present disclosure where multiple weakened regions and/or multiple strengthened regions of different forms are employed to further enhance the performance of a diffuser according to the present disclosure and to tailor its properties to a specific application.

The first strengthened region is preferably provided at a location on the diffuser that helps to focus the kinetic energy of parts of a failed compressor wheel impacting the diffuser at the first weakened region. It will be appreciated that this may be achieved using one or more weakened regions in combination with one or more specifically located strengthened regions. The first strengthened region may be provided immediately radially outboard of the first weakened region or immediately radially inboard of the first weakened region. The outer diameter of the first strengthened region may be approximately 1 to 30% of the outer diameter of the first weakened region, approximately 2 to 25% of the outer diameter of the first weakened region or approximately 5 to 20% of the outer diameter of the first weakened region.

The first strengthened region may be defined by a section of the diffuser member that has an axial thickness that is greater than the axial thickness of the first weakened region. It will be appreciated that this difference in axial thickness alone may be sufficient to ensure that the kinetic energy of high velocity fragments of a failed compressor wheel is focused satisfactorily at the weakened region to cause the diffuser member to fracture preferentially at the weakened region, which thereby defines a preferential shear plane. Alternatively, it may be a combination of features, including but not limited to the difference in thickness between the weakened region and the strengthened region that ensures that the diffuser member preferentially fractures at the weakened region. For example, the weakened region may be the axially thinnest region of the diffuser member as a whole, and while the diffuser member might fracture preferentially at the weakened region upon compressor wheel failure on this basis alone, the presence of the strengthened region in accordance with the present disclosure improves the extent to which forces are focused at the weakened region, thereby enhancing the containment properties of the compressor housing.

The first strengthened region may be defined by a first protrusion that extends generally axially from the diffuser member. Said first protrusion may extend generally axially from a back face of the diffuser member towards the bearing housing. Said first protrusion may be annular. Said first protrusion may be comprised of a plurality of circumferentially-spaced segments of an annular ring. Said first protrusion may define one or more generally radially and/or axially extending depressions. The or each depression may be defined by the end of the first protrusion that is furthest away from the diffuser member, that is, by a distal end of the first protrusion relative to the proximal end of the first protrusion that connects the first protrusion to the diffuser member.

The first weakened region may be defined, at least in part, by a groove provided in the diffuser member. The groove may be defined by a surface of the diffuser member that faces the compressor wheel or a surface that faces the bearing housing. As a further alternative, the first weakened region may be defined by a pair of grooves, one groove defined by the surface of the diffuser member that faces the compressor wheel and the other groove defined by the surface that faces the bearing housing. The groove(s) may be of any desirable form, for example annular. In a preferred embodiment, the surface of the diffuser member facing the compressor wheel defines a first annular groove with a first axial depth, while the surface of the diffuser member facing the bearing housing defines a second annular groove with a second axial depth which is greater than the first axial depth. The combination of the two annular grooves provides a significantly 'wasted' or 'thinned' region of the diffuser member in between them, but this is achieved without significant detriment to the aerodynamic properties of surface of the diffuser member that faces, and thereby lies directly behind, the compressor wheel.

The first weakened region may define a fracture plane that extends in any desirable direction through the diffuser member. Preferably, the first weakened region defines a fracture plane that extends generally axially through the diffuser member.

The first strengthened region may be radially outwards of the first weakened region and a second strengthened region may be defined at a third position intermediate the radially outer portion and the radially inner portion, said third position being radially inwards of the first weakened region. The second strengthened region may be provided immediately radially inboard of the first weakened region. The outer diameter of the second strengthened region may be approximately 70 to 99% of the outer diameter of the first weakened region, approximately 75 to 98% of the outer diameter of the first weakened region or approximately 80 to 95% of the outer diameter of the first weakened region.

The second strengthened region may be defined by a section of the diffuser member that has an axial thickness that may be greater than the axial thickness of the first weakened region. The second strengthened region may be defined by a second protrusion that extends generally axially from the diffuser member, optionally wherein said second protrusion extends generally axially from a back face of the diffuser member towards the bearing housing. Said second protrusion may be annular. Said second protrusion may be comprised of a plurality of circumferentially-spaced segments of an annular ring. Said second protrusion may define one or more generally radially and/or axially extending depressions as described above in relation to the first protrusion.

The first strengthened region may axially overlie the second strengthened region. The first and second strengthened regions may be separated by a slot that extends generally axially, or that extends transverse to the rotational axis of the compressor wheel. Said slot has a width orthogonal to its longitudinal axis, said width preferably being substantially constant along the length of the slot or said width reducing from one end of the slot to the opposite end of the slot.

A third strengthened region may be defined at a fourth position radially outwards of the first strengthened region. A second weakened region may be defined at a fifth position that may be different to said first position. The first weakened region and the second weakened region may be configured such that the first weakened region fractures in preference to the second weakened region when the compressor housing is impacted by a component of the compressor wheel following failure of the compressor wheel during use. The second weakened region may define a fracture plane that extends generally transverse to the rotational axis of the compressor wheel or that extends generally radially. The second weakened region may be defined by a section of the first strengthened region.

According to a second aspect of the present disclosure there is provided a turbocharger comprising a compressor according to the first aspect of the present disclosure.

Any of the optional features described above in relation to the compressor according to the first aspect of the present disclosure may be applied to the compressor forming part of turbocharger of the second aspect of the present disclosure.

The turbocharger of the second aspect of the present disclosure may be a fixed geometry turbocharger or a variable geometry turbocharger.

Other advantageous and preferred features of the disclosure will be apparent from the following description.

BRIEF DESCRIPTION OF THE DRAWINGS

Specific embodiments of the present disclosure will now be described, by way of example only, with reference to the accompanying drawings, in which.

DETAILED DESCRIPTION OF EMBODIMENTS OF THE DISCLOSURE

Figure 1:
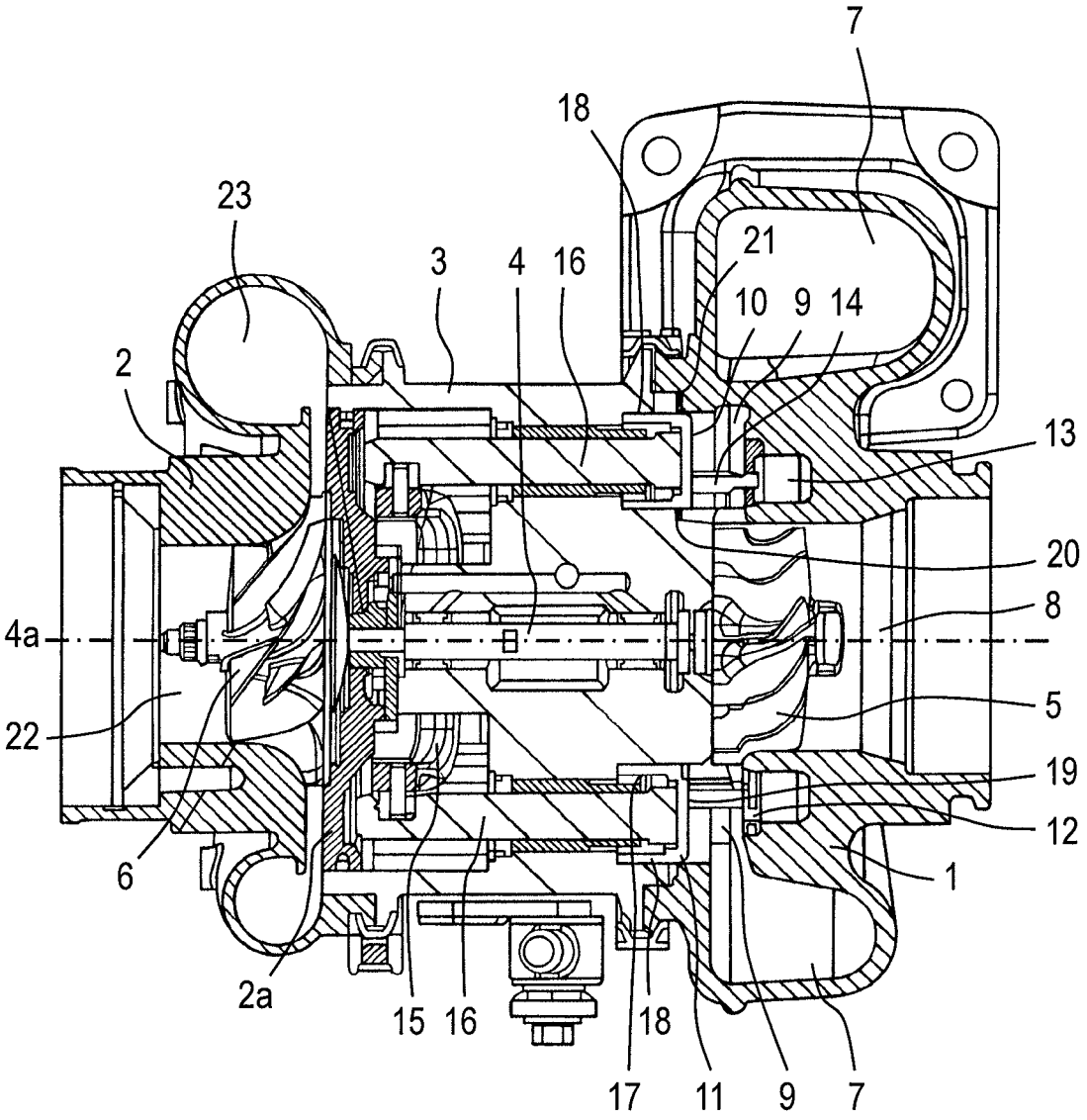
Fig. 1 (Prior Art)
FIG. 1 is an axial cross-section through a known variable geometry turbocharger.

Referring to FIG. 1, this illustrates a known variable geometry turbocharger comprising a housing comprised of a variable geometry turbine housing 1 and a compressor housing 2 (sometimes referred to as a compressor 'shroud') interconnected by a central bearing housing 3. A turbocharger shaft 4 extends from the turbine housing 1 to the compressor housing 2 through the bearing housing 3. A turbine wheel 5 is mounted on one end of the shaft 4 for rotation within the turbine housing 1, and a compressor wheel 6 is mounted on the other end of the shaft 4 for rotation within the compressor housing 2. The shaft 4 rotates about turbocharger axis 4*a* on bearing assemblies located in the bearing housing 3. In between the compressor housing 2 and the bearing housing 3 is a diffuser plate 2*a* which is recessed to accommodate an inboard portion of the compressor wheel 6, i.e. a portion nearest to the bearing housing 3, to increase the efficiency of the compressor stage.

The turbine housing 1 defines an inlet volute 7 to which gas from an internal combustion engine (not shown) is delivered. The exhaust gas flows from the inlet volute 7 to an axial outlet passage 8 via an annular inlet passage 9 and the turbine wheel 5. The inlet passage 9 is defined on one side by a face 10 of a radial wall of a movable annular wall member 11, commonly referred to as a "nozzle ring", and on the opposite side by an annular shroud 12 which forms the wall of the inlet passage 9 facing the nozzle ring 11. The shroud 12 covers the opening of an annular recess 13 in the turbine housing 1.

The nozzle ring 11 supports an array of circumferentially and equally spaced inlet vanes 14 each of which extends across the inlet passage 9. The vanes 14 are orientated to deflect gas flowing through the inlet passage 9 towards the direction of rotation of the turbine wheel 5. When the nozzle ring 11 is proximate to the annular shroud 12, the vanes 14 project through suitably configured slots in the shroud 12, into the recess 13.

The position of the nozzle ring 11 is controlled by an actuator assembly of the type disclosed in U.S. Pat. No. 5,868,552. An actuator (not shown) is operable to adjust the position of the nozzle ring 11 via an actuator output shaft (not shown), which is linked to a yoke 15. The yoke 15 in turn engages axially extending actuating rods 16 that support the nozzle ring 11. Accordingly, by appropriate control of the actuator (which may for instance be pneumatic or electric), the axial position of the rods 16 and thus of the nozzle ring 11 can be controlled. The speed of the turbine wheel 5 is dependent upon the velocity of the gas passing through the annular inlet passage 9. For a fixed rate of mass of gas flowing into the inlet passage 9, the gas velocity is a function of the width of the inlet passage 9, the width being adjustable by controlling the axial position of the nozzle ring 11. FIG. 1 shows the annular inlet passage 9 fully open. The inlet passage 9 may be closed to a minimum by moving the face 10 of the nozzle ring 11 towards the shroud 12.

The nozzle ring 11 has axially extending radially inner and outer annular flanges 17 and 18 that extend into an annular cavity 19 provided in the turbine housing 1. Inner and outer sealing rings 20 and 21 are provided to seal the nozzle ring 11 with respect to inner and outer annular surfaces of the annular cavity 19 respectively, whilst allowing the nozzle ring 11 to slide within the annular cavity 19. The inner sealing ring 20 is supported within an annular groove formed in the radially inner annular surface of the cavity 19 and bears against the inner annular flange 17 of the nozzle ring 11. The outer sealing ring 20 is supported within an annular groove formed in the radially outer annular surface of the cavity 19 and bears against the outer annular flange 18 of the nozzle ring 11.

Gas flowing from the inlet volute 7 to the outlet passage 8 passes over the turbine wheel 5 and as a result torque is applied to the shaft 4 to drive the compressor wheel 6. Rotation of the compressor wheel 6 within the compressor housing 2 pressurises ambient air present in an air inlet 22 and delivers the pressurised air to an air outlet volute 23 from which it is fed to an internal combustion engine (not shown).

Various modified versions of the diffuser plate 2*a* of FIG. 1 will now be described where parts corresponding to those shown in FIG. 1 will take the same reference number but increased by 100 each time.

Figure 2:
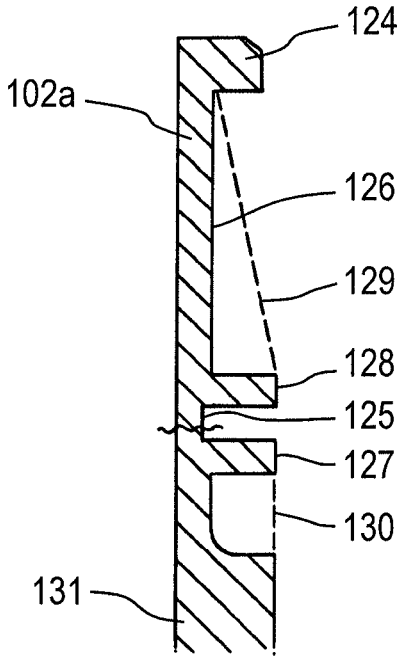
FIG. 2 is a radial cross-sectional view of a diffuser plate according to a first embodiment of the present disclosure.

A section of a first embodiment of a diffuser plate 102*a* according to the present disclosure is shown in FIG. 2. The diffuser plate 102*a* is of general disc-like configuration with a central aperture (not shown) for receiving the turbocharger shaft 104. The radially outer periphery of the diffuser plate 102*a* defines an axially extending flange 124 by which the diffuser plate 102*a* is connected to the bearing housing (not shown).

In this embodiment, the diffuser plate 102*a* incorporates an annular groove 125 which is defined by the side 126 of the diffuser plate 102*a* which faces the bearing housing (not shown). The annular groove 125 results in that section of the diffuser plate 102*a* being axially thinner than other sections of the diffuser plate 102*a* so that the annular groove 125 provides a region of weakness in the diffuser plate 102*a*, which thereby defines, in a predictable manner, the initial point at which the diffuser plate 102*a* would fracture upon impact by fragments of a failed compressor wheel (not shown). This ensures that the connection between the bearing housing (not shown) and the diffuser plate 102*a* is maintained as far as possible and thereby minimises the risk of oil leaking from the bearing housing (not shown). Since a significant portion, if not all, of the diffuser plate 102*a* remains connected to the part of the compressor housing (not shown) over which the compressor impeller blades sweep during normal use, the containment capability of the compressor housing as a whole is significantly improved.

Control of the first point at which fracture of the diffuser plate 102*a* begins is improved by the provision of a pair of axially extending annular rings 127, 128 either side of the annular grove 125. A first of the annular rings 127 lies radially inboard of the annular grove 125, while a second of the annular rings 128 lies radially outboard of the annular grove 125. In the present embodiment, the two annular rings 127, 128 are continuous, but further embodiments below describe modifications to this arrangement. Furthermore, in this embodiment, the two annular rings 127, 128 extend to the same axial position, however, it will be appreciated that this does not have to be the case and that the radially inboard annular ring 127 may be axially longer or shorter than the radially outer annular ring 128. The effect of the pair of annular rings 127, 128 is to stiffen the region of the diffuser plate 102*a* immediately radially inboard and outboard of the annular groove 125, which thereby acts to further focus impact forces at the position of the annular grove 125 and ensure, with greater certainty, that the diffuser plate 102*a* fractures preferentially at the annular groove 125 than if the pair of annular rings 127, 128 were not present.

Shown in dotted lines in FIG. 2 are two webs 129, 130, which may optionally be provided. The radially inner web 130 is a flat plate that connects the radially inner annular ring 127 to the hub 131 of the diffuser plate 102*a*, and which extends to the same axial position as the radially inner annular ring 127. The radially outer web 129 extends from the end of the radially outer annular ring 128 nearest the bearing housing (not shown) to the flange 124 provided at the radially outer periphery of the diffuser plate 102*a*. The radially outer web 129 is in the form of a flat plate which, in the FIG. 2 embodiment, extends from the end of the radially outer annular ring 128 nearest the bearing housing (not shown) to a position on the flange 124 that is closer to the surface 126 of the diffuser plate 102*a* which faces the bearing housing (not shown), i.e., the edge of the radially outer web 129 nearest the bearing housing (not shown) does not extend radially, but rather at a non-zero angle to a plane parallel to the major plane of the diffuser plate 102*a*. It will be appreciated that, while it may be preferable to have a single radially inner web 130 and/or a single radially outer web 129, it may be preferable in certain applications to have multiple angularly spaced webs 129, 130 connecting the or each annular ring 127, 128 to other sections of the diffuser plate 102*a*.

Figure 3:
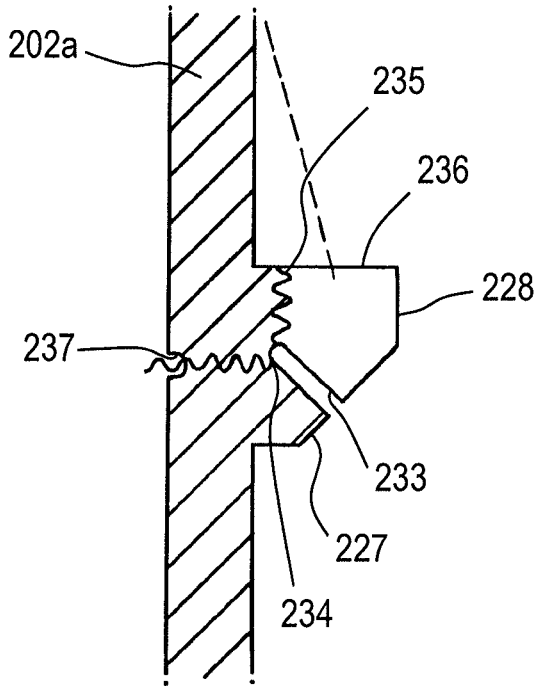
FIG. 3 is a radial cross-sectional view of a diffuser plate according to a second embodiment of the present disclosure.

FIG. 3 shows a second embodiment of the present disclosure in which the diffuser plate 202*a* defines a preferential shear plane through the diffuser plate 202*a* by virtue of the provision of a pair of axially extending annular rings 227, 228, which differ in form as will now be described from the pair of annular rings 127, 128 described above in relation to FIG. 2. In the FIG. 3 embodiment, the radially inner annular ring 227 is separated from the radially outer annular ring 228 by a slot 233 which extends along an axis which defines a non-zero angle to the rotational axis of the compressor wheel (not shown). In the embodiment shown in FIG. 3, the slot 233 extends along an axis that subtends an angle of approximately 45° to the rotational axis of the compressor wheel (not shown). It will be appreciated that this angle can be varied to optimize the arrangement for use in different applications. For example, the slot may extend along an axis that subtends an angle in the range of approximately 20-70° or 30-60° to the rotational axis of the compressor wheel (not shown). Machining or otherwise forming an inclined slot 233 in this way results in the two annular rings 227, 228 operating in the form of a "latching" mechanism upon fracture of the diffuser plate 202*a* along the preferential fracture plane. When a compressor wheel (not shown) fails, fragments of the failed compressor wheel impinge upon the diffuser plate 202*a* and, upon shearing of the diffuser plate 202*a* along the preferential fracture plane result in the section of the diffuser plate 202*a* radially outboard of the preferential fracture plane pivoting about a point 234 where the preferential fracture plane meets the slot 233. As a result of this pivoting, the radially outer annular ring 228 also pivots about the point 234, closing the slot 233 and bringing the radially outer annular ring 228 into contact with the radially inner ring 227. As a result, further pivoting of the radially outer annular ring 228 is prevented, as is further pivoting of the section of the diffuser plate 202*a* radially outboard of the peripheral fracture plane, which thereby keeps it in place. Should the impact force of the fragments from the failed compressor wheel (not shown) be sufficiently high, this arrangement has the further benefit of defining a secondary fracture plane 235 extending from the closed end of the inclined slot 233 to the radially outer edge 236 of the radially outer annular ring 228. Thus, the reaction force of the radially inner annular ring 227 on the radially outer annular ring 228 may, in some circumstances, be sufficiently high to cause the radially outer annular ring 228 to fracture along the secondary fracture plane 235, thereby absorbing yet further energy from the fragments impacting the diffuser plate 202*a*.

In the embodiment shown in FIG. 3, a further optional feature is shown. This is in the form of an annular groove 237 defined by the surface of the diffuser plate 202*a* which faces the compressor wheel (not shown). It will be appreciated that the provision of this annular ring, which in this embodiment extends axially across approximately 20% of the axial thickness of the diffuser plate 202*a*, reduces the axial thickness of the diffuser plate 202*a* at a diameter that approximately corresponds to the diameter of the closed end of the inclined slot 233 and thereby serves to further focus impact forces at the preferential shear plane. The depth of the annular groove 237 can be selected based upon the particular application, but may reduce the axial thickness of the diffuser plate 202*a* at that point by an amount in the range of approximately 5 to 30%. Finally, it will be appreciated that radially inner or outer webs may be provided in the embodiment shown in FIG. 3 as described above in relation to the embodiment shown in FIG. 2.

Figure 4:
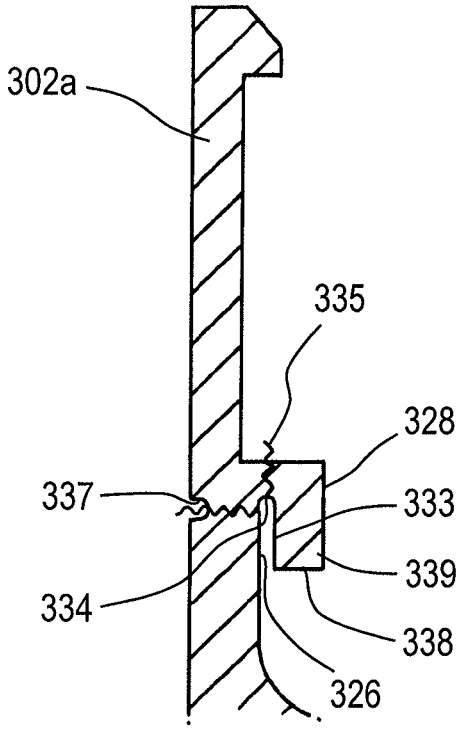
FIG. 4 is a radial cross-sectional view of a diffuser plate according to a third embodiment of the present disclosure.

Referring now to FIG. 4, this shows a third embodiment of a diffuser plate 302*a* which has been designed to define a preferential fracture plane 332 extending axially through the diffuser plate 302*a* from an annular groove 337 in the surface of the diffuser plate 302*a* that faces the compressor wheel (not shown) and a section of a slot 333 which, in this embodiment, extends radially from a radially inner end 338 of a single annular ring 328 radially outwards. In this embodiment, an axially extending radially outer annular ring 328 is provided which incorporates a radially inwardly extending annular rim 339 which, in combination with the surface 326 of the diffuser plate 302*a* that faces the bearing housing (not shown) defines the radially extending slot 333.

In this embodiment, when fragments of a failed compressor wheel (not shown) impinge upon the diffuser plate 302*a*, the diffuser plate 302*a* fractures preferentially along preferential fracture plane 332, the section of the diffuser plate 302*a* radially outboard of a preferential fracture plane 332 is designed to pivot around the point 334 at which the preferential fracture plane 332 meets the radial slot 333. This then results in the diffuser plate 302*a* following a similar "latching" mechanism to that described above in relation to the embodiment shown in FIG. 3. Pivoting of the section of the diffuser plate 302*a* lying radially outboard of the preferential fracture plane 332 may, in certain circumstances, again result in fracturing of the radially outer annular ring 328 along a secondary fracture plane 335, which again allows the arrangement to absorb more energy from the fragments of the failed compressor wheel (not shown).

Figure 5:
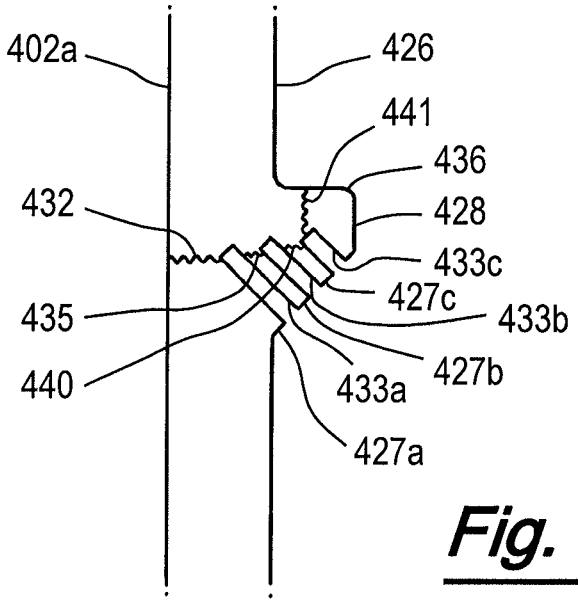
FIG. 5 is a radial cross-sectional view of a diffuser plate according to a fourth embodiment of the present disclosure.

FIG. 5 shows a development to the second embodiment shown in FIG. 3. In the development shown in FIG. 5, there is not one inclined slot 233, but rather three parallel inclined slots 433*a*, 433*b* and 433*c*. The use of multiple machined (or otherwise formed) inclined slots enables the energy absorbing capacity and mechanism to be tailored to meet the particular demands of a specific application. In the embodiment shown in FIG. 5, the surface of the diffuser plate 402*a* facing the compressor wheel (not shown) does not define an annular groove. Instead, the preferential fracture plane is defined by an axially narrowed region of the diffuser plate 402*a* as a result of the radially and axially innermost inclined slot 433*a* extending to a depth that is approximately half way between the surface of the diffuser plate 402*a* that faces the compressor wheel (not shown) and the opposite surface 426 of the diffuser plate 402*a* that faces the bearing housing (not shown) at a diameter lying immediately radially outboard of the radially outermost annular ring 428. Furthermore, in this embodiment, there can be considered to be a radially outer annular ring 428 and three radially inner annular rings 427*a*, 427*b*, 427*c*. By providing multiple radially inner annular rings 427*a*, 427*b*, 427*c*, all of which extend to approximately the same diameter matching that of the preferential fracture plane, a secondary fracture plane 435 is defined between the radially innermost pair of inclined slots 433*a*, 433*b*, and a tertiary fracture plane 440 is defined between the radially outer pair of inclined slots 433*b*, 433*c*. This then results in a quaternary fracture plane 441 being defined which extends approximately radially from the closed end of the radially outermost inclined slot 433*c* to the radially outer edge 436 of the radially outer annular ring 428 which is likely to fracture only upon pivoting of the section of the diffuser plate 402*a* lying radially outboard of the preferential fracture plane and secondary and tertiary fracture planes 435, 440 following the "latching" mechanism described above in relation to the embodiments shown in FIGS. 3 and 4.

It will be appreciated that while the embodiment shown in FIG. 5 employs essentially a three-part radially inner ring 427*a*, 427*b*, 427*c* in combination with a single radially outer ring 428 to define three inclined slots 433*a*, 433*b*, 433*c*, it may be desirable in certain applications to employ an arrangement incorporating a fewer number or, conversely, a greater number of radially inner annular rings 427 and/or radially outer rings 428 so as to define any desirable number of slots, which may be inclined, radial or axial, to provide a diffuser plate having the containment properties required for a particular application.

Figure 6A:
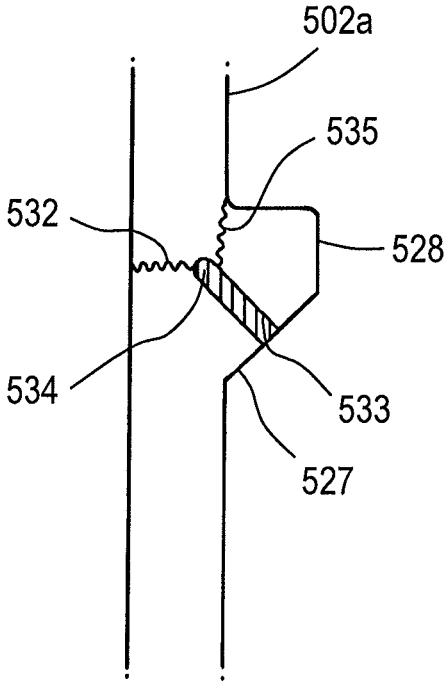
FIG. 6*a* is a radial cross-sectional view of a diffuser plate according to a fifth embodiment of the present disclosure.
Figure 6B:
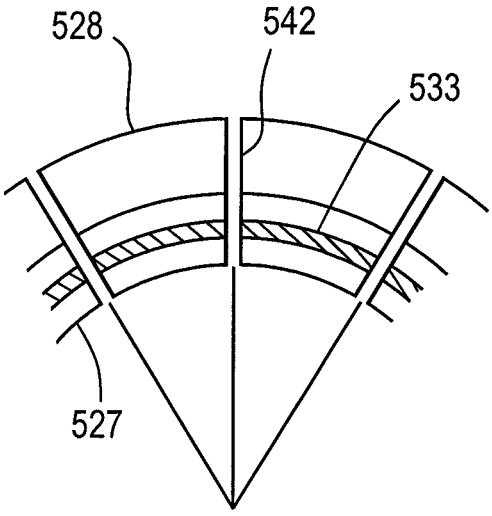
FIG. 6*b* is an axial cross-sectional view of the diffuser plate of FIG. 6*a;*

Turning now to FIGS. 6*a* and 6*b*, there is shown a further embodiment of a diffuser plate 502*a* according to the present disclosure which corresponds generally to the embodiment shown in FIG. 3 and which will not be further described in any detail save for the differences incorporated into the present embodiment. FIG. 6*a* is a radial cross-sectional view of the diffuser plate 502*a* showing radially inner and outer axially extending annular rings 527, 528 which are separated by an inclined slot 533 similar to the embodiment shown in FIG. 3. FIG. 6*b* highlights the difference between the present embodiment and that of FIG. 3. In FIG. 3, the radially inner and outer annular rings 227, 228 were continuous rings, whereas in the present embodiment, the radially inner and outer rings 527, 528 are each made up of a plurality of equi-angularly segments separated by slots 542 extended radially through the radially inner and outer annular rings 527, 528. The provision of the radial slots 542 enables the stiffness of the "latching" mechanism to be moderated to suit a particular application. That is, provision of one or more radial slots 542 through the radially inner and outer annular rings 527, 528 decreases the stiffness of the annular rings 527, 528 such that the or each annular ring 527, 528 can deform more readily under the load generated by fragments of a failed compressor wheel (not shown) impacting the diffuser plate 502*a*. As will be appreciated, in general, the greater the number of radial slots 542, the lower the stiffness of the "latching" mechanism and so the more easily the radially outer annular ring 528 can pivot about point 534 before closing the slot 533 and contacting the radially inner annular ring 527.

It will be appreciated that one or more radial slots 542 may be provided and that said slots 542 may extend through just the radially outer annular ring 528, just the radially inner annular ring 527, or they may extend through both annular rings 527, 528 as shown in the embodiment depicted in FIG. 6*b*. Provision of the radial slots 542 has the further advantage of removing material from one or both of the annular rings 527, 528 and thereby lightens the diffuser plate 502*a* as a whole. In some applications, it may be desirable to provide radial slots 542 which are not equi-angularly spaced and/or which extend along a first radial line through the radially outer annular ring 528 and along a different radial line through the radially inner annular ring 527. That is, while the slots 542 through the radially inner and outer annular rings 527, 528 are shown in FIG. 6*b* as being "in register", i.e. lined-up, it may be advantageous in certain applications for adjacent slots 542 extending through the radially inner annular ring 527 and the radially outer annular ring 528 not to lie in register, i.e. to be angularly offset. The or each radial slot 542 through the radially inner annular ring 527 may be linear as shown in FIG. 6*b*, and similarly, the or each radial slot 542 in the radially outer annular ring 528 may be linear as shown in FIG. 6*b*. However, this does not have to be the case. The or each radial slot 542 extending through the radially inner annular ring 527 may be curved within a plane parallel to the major plane of the diffuser plate 528*a* and/or curved into/out of said plane. The same may apply, independently, to the or each slot 542 extending through the radially outer annular ring 528. Additionally, the or each radial slot may taper inwards or outwards from its radially inner end to its radially outer end within said plane and/or into/out of said plane.

Figure 7:
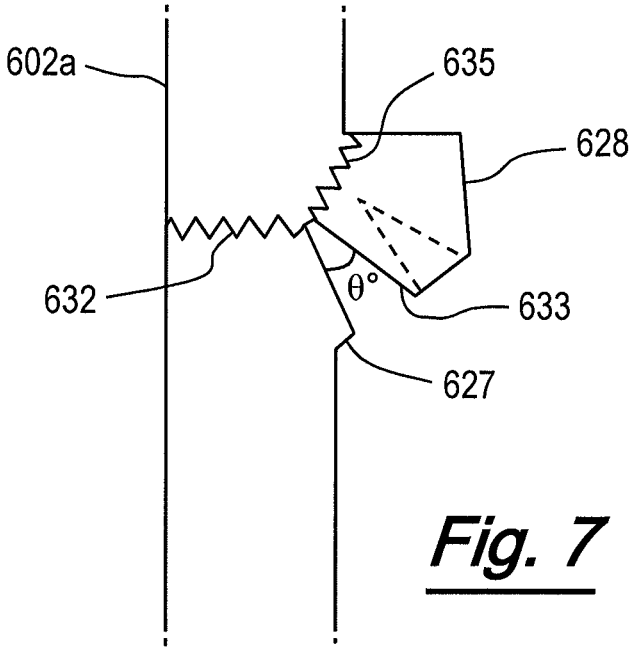
FIG. 7 is a radial cross-sectional view of a diffuser plate according to a sixth embodiment of the present disclosure.

FIG. 7 shows a further alternative embodiment which is again similar to the embodiment shown in FIG. 3 described above but in which the diffuser plate 602*a* incorporates a radially inner annular ring 627 which is separated from a radially outer annular ring 628 by a slot 633 which has non-parallel sides. In the embodiment shown in FIG. 7, the slot 633 tapers inwardly from its open end to its closed end such that the walls of the slot are separated by an angle of approximately 45°. It will be appreciated that this angle may take any appropriate value to arrive at an arrangement which provides the desired failure mode and thereby containment capability based on the particular application. The angle between the opposing walls of the slot 633 may therefore be any non-zero angle between around 5° and around 90°. Furthermore, as shown in dotted lines on FIG. 7, this embodiment is not limited to the use of a single slot 633, rather, multiple slots 633 may be provided having a tapering cross-section when viewed in radial cross-section as shown in FIG. 7. Furthermore, where multiple slots 633 are provided, the radial cross-sectional profile of the slots may all be generally the same or may differ from one slot to another.

Figure 8:
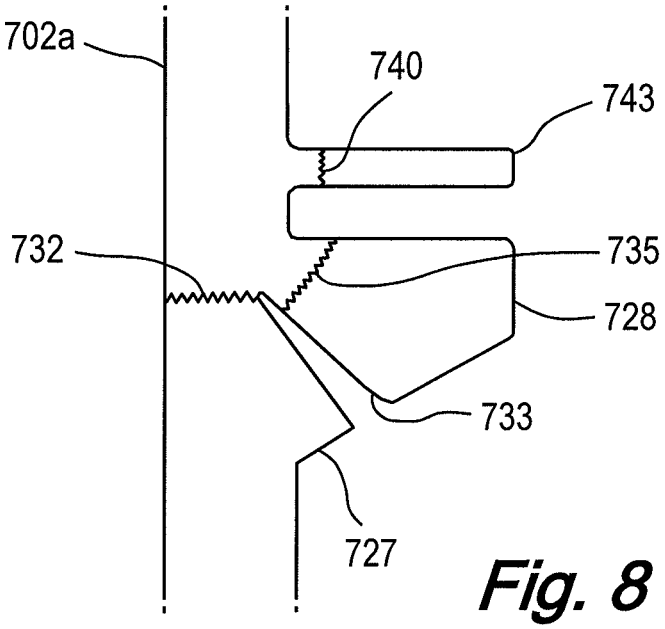
FIG. 8 is a radial cross-sectional view of a diffuser plate according to a seventh embodiment of the present disclosure.

Referring to FIG. 8, this shows a further embodiment of a diffuser plate 702*a* according to an embodiment of the present disclosure. The present embodiment is again similar in many respects to the embodiment shown in FIG. 3 described above, but in the present embodiment incorporates a further axially extending annular ring 743 which is positioned radially outboard of the radially outer annular ring 728. The purpose of the additional annular ring 743 is to provide additional shielding to prevent the radially inner and outer annular rings 727, 728 shearing and being ejected radially upon fracturing of the diffuser plate 702*a* along preferential fracture plane 732 and secondary fracture plane 735. As a result of the form of the additional annular ring 743, it defines a tertiary fracture plane 740 running radially through the radial thickness of the annular ring 743 immediately outboard of the point at which the additional annular ring 743 connects to the diffuser plate 702*a*. It is envisaged that providing this additional shielding capability will have particular application in larger frame sizes, that is, compressors and turbochargers incorporating larger diameter compressor wheels where impact forces generated by fragments of a failed compressor wheel hitting the diffuser plate are likely to be higher than the forces generated due to failure of a smaller diameter compressor wheel. It will be appreciated that the present embodiment may incorporate any number of additional axially extending annular rings 743 and that they may take any desirable form in terms of their thickness and/or radial cross-sectional profile. Additionally, the size, shape and form of the or each radially inner annular ring 727 and radially outer ring 728 may be chosen to suit a particular application. Any of the compatible features in the embodiments described in relation to FIGS. 2 to 7 may be incorporated into the embodiment shown in FIG. 8. For example, the extra shielding provided by the additional annular ring 743 may find particular application where the radially inner annular ring 727 and/or radially outer annular ring 728 is provided with one or more radially extending slots (not shown) as described above with reference to FIGS. 6*a* and 6*b*.

Figure 9A:
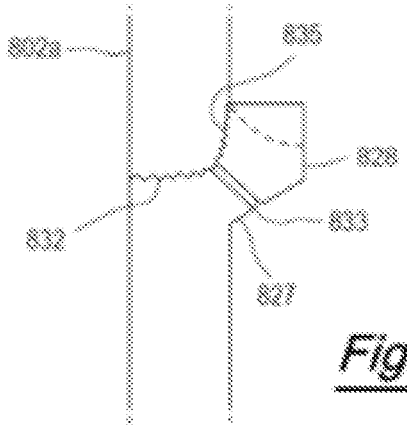
FIG. 9*a* is a radial cross-sectional view of a diffuser plate according to an eighth embodiment of the present disclosure.
Figure 9B:
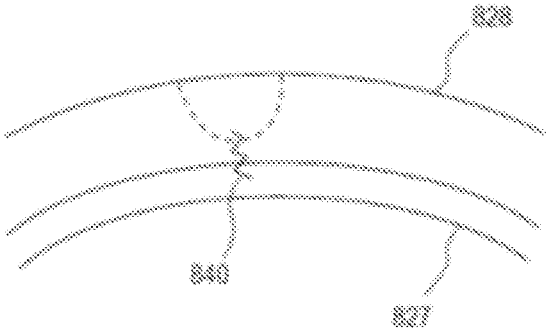
FIG. 9*b* is an axial cross-sectional view of a diffuser plate of FIG. 9*a*.

FIGS. 9*a* and 9*b* provide a radial cross-sectional view and an axial cross-sectional view respectively of a section of a diffuser plate 802*a* according to a further embodiment of the present disclosure. In this embodiment, a similar arrangement of radially inner and outer annular rings 827, 828 separated by an inclined slot 833 is provided as shown in FIG. 3, but in the present embodiment, the radially outer annular ring 828 has been stamped or otherwise formed so as to define one or more radially and, optionally axially, extending depressions or "pockets" which intermittently reduce the radial thickness of the radially outer annular ring 828 and thereby define one or more tertiary fracture planes 840 extending radially from the bottom of the or each depression through the radially outer annular ring 828 to the slot 833, in addition to the preferential fracture plane 832 and the secondary fracture plane 835. Such depressions may be used in combination with radial slots (not shown) of the kind described above with reference to FIGS. 6*a* and 6*b*, or may be used instead of such radial slots. It will be appreciated that forming such depressions may be easier from a manufacturing perspective than machining (or otherwise forming) radial slots through one or more of the annular rings 827, 828. Again, it will also be appreciated that the use of depressions is not limited to the particular embodiments shown in FIGS. 9*a* and 9*b* and may be applied in combination with any of the features described above in relation to FIGS. 2 to 8.

It will be appreciated that the disclosure is also applicable to the turbine stage of a turbo-charger in order to prevent the bearing housing leaking oil into the exhaust and creating the risk of both fire and explosion.

It will be appreciated that numerous modifications to the above described design may be made without departing from the scope of the disclosure as defined in the appended claims. For example, the diffuser flange may be weakened locally in any suitable way; the annular groove described above is to be regarded as an example only. Moreover, the impeller could be constructed from any suitable material. Moreover, any one or more of the above described preferred embodiments could be combined with one or more of the other preferred embodiments to suit a particular application.

The described and illustrated embodiments are to be considered as illustrative and not restrictive in character, it being understood that only the preferred embodiments have been shown and described and that all changes and modifications that come within the scope of the disclosures as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the disclosure as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A compressor comprising:

a compressor housing, a compressor wheel mounted within the housing and having compressor blades, a bearing housing, and a diffuser member that is connected to both the compressor housing and the bearing housing, the diffuser member having a radially outer portion connected to the compressor housing and a radially inner portion connected to the bearing housing;

wherein the diffuser member has a first weakened region defined at a first position intermediate the radially outer portion and the radially inner portion, a first strengthened region defined at a second position intermediate the radially outer portion and the radially inner portion and a second weakened region defined at a position that is different to said first portion, said second position being radially inwards or outwards of the first weakened region; and wherein the first weakened region defines a fracture plane that extends axially and the second weakened region defines a fracture plane that extends transverse to a rotational axis of the compressor wheel or that extends radially.

2. A compressor according to claim 1, wherein the first strengthened region is defined by a section of the diffuser member that has an axial thickness that is greater than an axial thickness of the first weakened region.

3. A compressor according to claim 1, wherein the first strengthened region is defined by a first protrusion that extends axially from the diffuser member.

4. A compressor according to claim 3, wherein said first protrusion extends axially from a back face of the diffuser member towards the bearing housing.

5. A compressor according to claim 3, wherein said first protrusion is annular.

6. A compressor according to claim 3, wherein said first protrusion is comprised of a plurality of spaced segments of an annular ring.

7. A compressor according to claim 3, wherein said first protrusion defines one or more radially extending depressions.

8. A compressor according to claim 1, wherein the first weakened region is defined, at least in part, by a groove provided in the diffuser member.

9. A compressor according to claim 8, wherein said groove is annular.

10. A compressor according to claim 3, wherein the first strengthened region is radially outwards of the first weakened region and a second strengthened region is defined at a third position intermediate the radially outer portion and the radially inner portion, said third position being radially inwards of the first weakened region.

11. A compressor according to claim 10, wherein the second strengthened region is defined by a section of the diffuser member that has an axial thickness that is greater than an axial thickness of the first weakened region.

12. A compressor according to claim 10, wherein the second strengthened region is defined by a second protrusion that extends generally axially from the diffuser member.

13. A compressor according to claim 12, wherein said second protrusion extends generally axially from a back face of the diffuser member towards the bearing housing.

14. A compressor according to claim 10, wherein the first strengthened region axially overlies the second strengthened region.

15. A compressor according to claim 14, wherein the first and second strengthened regions are separated by a slot that extends generally transverse to a rotational axis of the compressor wheel.

16. A compressor according to claim 15, wherein said slot has a width orthogonal to its longitudinal axis, said width being constant along a length of the slot or said width reducing from one end of the slot to an opposite end of the slot.

17. A compressor according to claim 10, wherein a third strengthened region is defined at a fourth position radially outwards of the first strengthened region.

18. A compressor according to claim 1, wherein the first weakened region and the second weakened region are configured such that the first weakened region fractures in preference to the second weakened region when the compressor housing is impacted by a component of the compressor wheel following failure of the compressor wheel during use.

19. A compressor according to claim 1, wherein the second weakened region is defined by a section of the first strengthened region.

20. A turbocharger comprising a compressor according to claim 1.

* * * * *